United States Patent [19]

Bone

[11] Patent Number: 4,654,935

[45] Date of Patent: Apr. 7, 1987

[54] STRUCTURE, USE AND MANUFACTURE OF FASTENERS

[75] Inventor: Arnold R. Bone, Needham, Mass.

[73] Assignee: Dennison Manufacturing Company, Framingham, Mass.

[21] Appl. No.: 679,737

[22] Filed: Dec. 10, 1984

[51] Int. Cl.[4] ..... A44B 9/00; B65D 85/24

[52] U.S. Cl. ..... 24/150 FP; 24/150 R; 40/20 R; 227/67; 206/343

[58] Field of Search ..... 24/150 FP, 150 R; 40/20 R; 227/67; 206/343

[56] References Cited

U.S. PATENT DOCUMENTS

| | | | |
|---|---|---|---|
| 2,825,162 | 3/1958 | Flood | 40/20 R |
| 3,103,666 | 9/1963 | Bone | 227/67 |
| 3,399,432 | 9/1968 | Merser | 24/150 FP |
| 3,470,834 | 10/1969 | Bone | 227/67 |
| 3,765,110 | 10/1973 | Olsen | 40/20 R |
| 3,850,297 | 11/1974 | Merser | 206/343 |
| 3,875,648 | 4/1975 | Bone | 40/20 R |
| 4,215,807 | 8/1980 | Ritter et al. | 227/67 |
| 4,315,587 | 2/1982 | Ritter et al. | 227/67 |
| 4,347,932 | 9/1982 | Furutu | 206/343 |
| 4,417,656 | 11/1983 | Kato | 227/67 |

FOREIGN PATENT DOCUMENTS

| | | | |
|---|---|---|---|
| 115288 | 10/1974 | Japan | 24/150 FP |

*Primary Examiner*—Victor N. Sakran

*Attorney, Agent, or Firm*—George E. Kersey; Barry D. Josephs

[57] ABSTRACT

An attachment device, method of producing the same, and method of using in which the attachment has a cross bar joined to a head by a connector forming different angular transitions with the respective head and cross bar. The result is a toggle effect which promotes proper orientation of the cross bar with respect to the connector after the cross bar has been inserted into an object.

13 Claims, 5 Drawing Figures

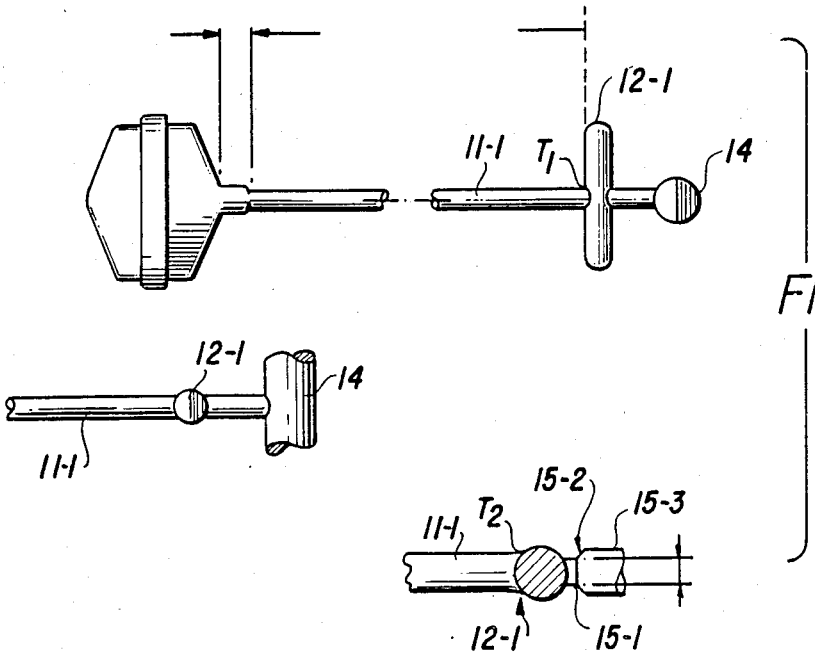
FIG. 3A
FIG. 3B
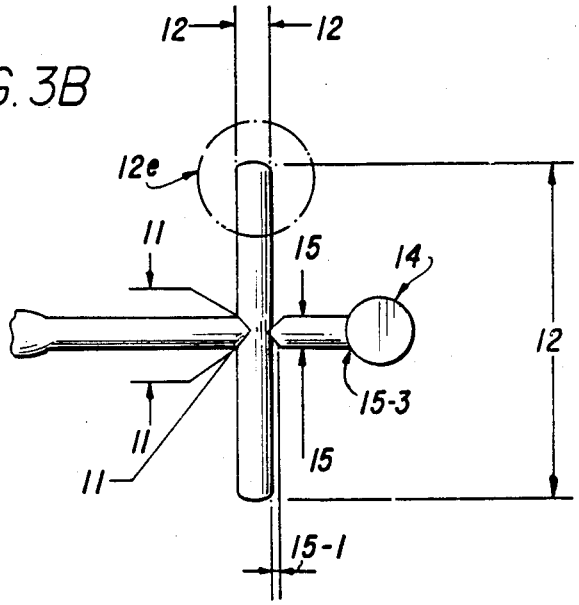

STRUCTURE, USE AND MANUFACTURE OF FASTENERS

BACKGROUND OF THE INVENTION

This invention relates to attachment devices and more particularly to their structure, manufacture and use.

A widely known type of device that is particularly useful in attaching tags to garments is in accordance with U.S. Pat. No. 3,444,597. Each device is in the form of an elongated element or connector which joins a head member to a cross bar. The cross bar is typically applied from the bore of a slotted hollow needle, with the connector extending outwardly from the needle along the slot. When the needle is inserted into an object for which an attachment is desired, for example a price tag to a garment, the price tag is first positioned between the needle and the garment, following which the cross bar is propelled through the needle to the opposite side of the garment. In the propulsion process, the connector is folded against the cross bar. Once the cross bar is expelled from the needle it tends to reassume its original, relatively perpendicular orientation relative to the connector.

In the case of a typical attachment there is a smooth radius and transition between the cross bar and the connector. This transition often interferes with the desired restoration of the cross bar to its perpendicular position relative to the connector once the cross bar has been propelled through the garment and expelled from the needle.

Accordingly it is an object of the invention to facilitate the use and manufacture of attachment devices. A related object is to facilitate the use and manufacture of attachment devices which are individually formed by connectors that join enlarged head portions to cross bars, the latter being perpendicularly disposed in relation to their associated connectors.

Another object of the invention is to promote the restoration of cross bars to their original equilibrium position after being expelled from the bores of slotted hollow needles. Another object of the invention is to facilitate the rapid, low cost attachment of tags to objects such as garments. A related object is to increase the number of fasteners per unit length of assemblages of fasteners used in fastener dispensing devices. A related object is to achieve increased packaging of fasteners without detriment to the ability of individual fasteners to regain their original equilibrium positions after being expelled from a fastener dispensing device.

SUMMARY OF THE INVENTION

In accomplishing the foregoing and related objects the invention provides attachments in which each has a connector that forms a different transition with a cross bar. In one orientation, the connector forms a gradual transition with the cross bar, while in another orientation, the transition is relatively abrupt. The use of an abrupt transition, coupled with a gradual transition, provides a toggle effect which promotes the reorientation of the cross bar after it has been folded against the connector and driven into an object.

In accordance with one aspect of the invention, the connector is tangential to the cross bar between planes that are perpendicular to the cross bar at its junction with the connector. The connector is desirably tangential to the cross bar at its cross sectional bisector. The cross bar desirably is connected to a neck which is coaxial with the connector.

In accordance with still another aspect of the invention, the abrupt transition between the connector and the cross bar is angular, and forms substantially a right angle.

In accordance with yet another aspect of the invention the cross bar is joined to a neck by an intermediate region which has a smaller diameter than the neck, and neck advantageously has a tapered transition to the intermediate region.

DESCRIPTION OF THE DRAWINGS

Other aspects of the invention become apparent after considering several illustrative embodiments, taken in conjunction with the drawings in which:

FIG. 3 is a partial plan view of the assemblage of attachments shown in FIG. 2;

FIG. 3B is a partial view showing the connection of cross bars to a connector in accordance with the invention;

FIG. 3C is a partial plan view of FIG. 3B.

DETAILED DESCRIPTION

Figure 1:
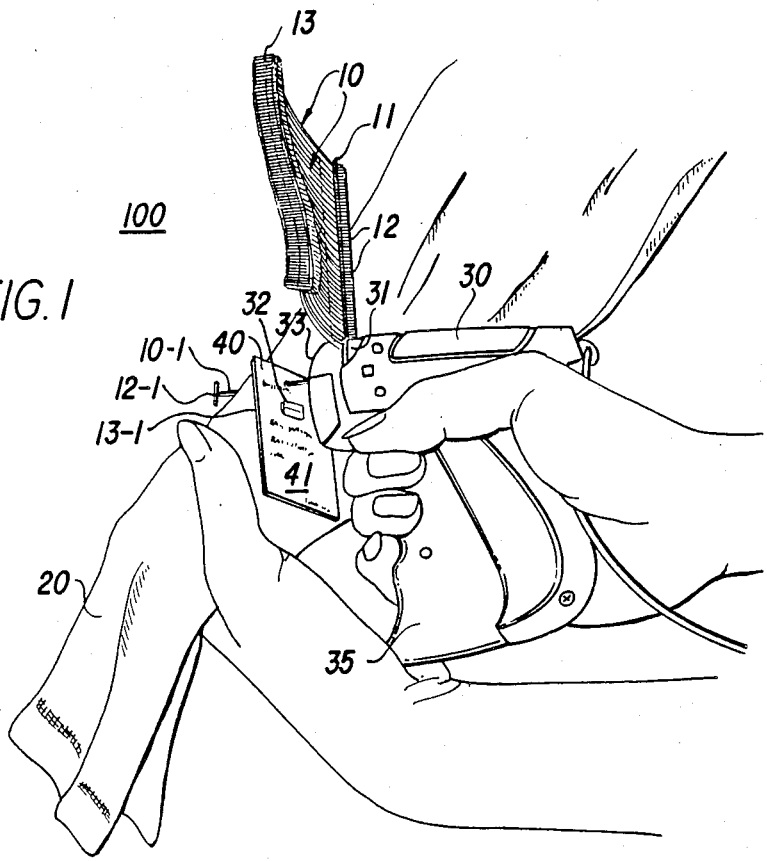
FIG. 1 is a diagram illustrating the application of attachments in accordance with the invention in the tagging of articles.

With reference to the drawings, FIG. 1 shows an assemblage 100 of individual attachments 10 being used in the tagging of an illustrative item 20 of merchandise using an attacher gun 30.

As indicated in FIG. 1, the merchandise 20 illustratively a piece of cloth, is being tagged with a ticket 40 by one of the attachments 10-1 of the assemblage 100. For that purpose, the assemblage is inserted into a receiving channel of the gun 30 so that the individual connectors 11 of the attachments 10 extend outward through a slot 31. An illustrative gun 30 is of the kind shown in U.S. Pat. No. 4,416,407 which issued Nov. 22, 1983 to Arnold R. Bone. The gun 30 includes an internal plunger (not visible in FIG. 1) that is used in driving a cross bar 12 of an individual fastener 10 through the bore of a slotted hollow needle 32 mounted at the frontal portion 33 of the gun 30. In the tagging operation, the tag or label 40 is inserted upon the needle 32 until its surface 41 engages the gun surface 33. The gun 30 and the tag 40 are then thrust through the merchandise 20 so that the needle 32 projects through the merchandise 20 to the other side. The trigger 35 of the gun 30 is then depressed to expel the cross bar 12-1 of the attachment 10-1 through the merchandise 20. This operation leaves the head portion 13-1 joined to the connector 11-1 so that when the needle 32 is withdrawn, the tag 40 is held to the merchandise 20 by the head portion 13-1 of the attachment 10-1.

In many attaching operations of the kind illustrated in FIG. 1, the cross bar 12-1, which is folded against the connectors 11-1, as the cross bar 12-1 is driven through the merchandise, does return quickly to its equilibrium position with the cross bar 12-1 perpendicular to the connector 11-1. In some cases, the recovery of the equilibrium position is so slow that the attachment 10-1 can be withdrawn deliberately or accidentally from the merchandise, and thus defeat the tagging operation.

Figure 2:
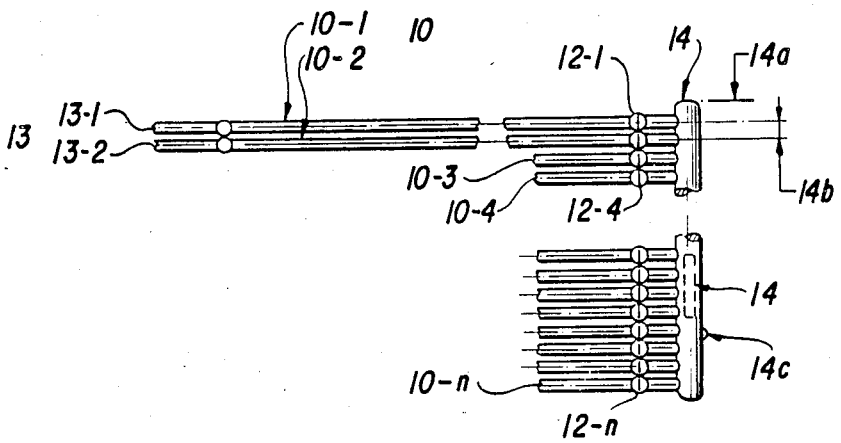
FIG. 2 is a partial end view of an assemblage of attachments in accordance with the invention.

The invention overcomes the delays often encountered in restoration of the desired equilibrium position of the cross bar, after passage through the merchandise, by the introduction of a toggle structure at the junction of the connector with its associated cross bar. The toggle structure is specifically illustrated in FIGS. 3A through 3C. In addition, as indicated in FIG. 2, the individual fasteners or attachments 10 are closely spaced upon a runner 14, without hindrance to the desired toggle effect. In this way, a large number of individual attachments 10 can be positioned upon a relatively short runner 14 and thus permit an increase in the number of attachments used with each assemblage having a prescribed length runner 14.

As indicated in FIG. 3A, the illustrative connector 11-1 is joined to its associated cross bar 12-1 by a relatively abrupt transition $T_1$ at an angle of about 90 degrees between the cross bar 12-1 and the connector 11-1. The actual junction of the connector and the cross bar can also be at a 90 degree angle, or can be a fillet with a slight reduction.

By contrast as shown in FIG. 3B, the same connector 11-1 forms a relatively gradual transition at an angle greater than 90 degrees relative to the cross bar 12-1. The second transition $T_2$ is more gradual than the other transition $T_1$ and can be associated with a much larger radius of curvature.

The plan view of the transition of FIG. 3B is set forth in FIG. 3C.

As a result of the differences in the degree of transition $T_1$ and $T_2$, the cross bar 12-1 produces an automatic toggle effect after being released from its condition of being folded against the connector 11-1, upon emergence from the bore of a slotted hollow needle used in driving the attachment through an object in the manner depicted in FIG. 1.

Representative of parameters associated with the assemblage 100 and the individual fasteners 10 are the following:

The cross bars 12-1 have a diameter of about 30 mils and a length from end to end of about 300 mils. The runner has an illustrative diameter of 60 mils and is joined to the cross bar by a neck 15-1 with a diameter of about 25 mils extending to a taper 15-2 of about 30 degrees and a transitional neck 15-3 to the cross bar 12-1. The transition $T_1$ has an illustrative 2 mils radius while the transition $T_2$ is blended from the connector 11-1 to the cross bar 12-1.

The individual attachments 10-1 are spaced from one another by a pitch of about 45 mils and each attachment has a diameter as molded on the order of 30 mils. Each fastener as molded has a length on the order of 1.4 inches.

Following molding the attachments 10 are stretched to extend the length as molded to approximately triple. There is a corresponding reduction in the connector diameter at the cross bar from about 28 mils to about 15 mils.

Other aspects of the invention will be apparent to those of ordinary skill in the art.

I claim:

1. An attachment comprising a cross bar, a head portion and a connector joining said cross bar to said head portion;

said connector forming a first transition angle with said cross bar in one orientation and a second transition angle, different from the first, in another orientation;

thereby to provide a toggle effect which promotes the reorientation of said cross bar relative to its equilibrium position after said attachment has been used by having said cross bar folded against said connector driven into an object.

2. Apparatus as defined in claim 1 wherein said connector is tangential to said cross bar between planes perpendicular to said cross bar at the junction of said connector which said cross bar and a plane parallel to said filament and tangential to said cross bar.

3. Apparatus as defined in claim 1 wherein said connector is oblong in cross section.

4. Apparatus as defined in claim 1 wherein said connector is tangential to said cross bar at the cross sectional bisector thereof.

5. Apparatus as defined in claim 1 wherein said cross bar is further connected to a neck which is opposite from and coaxial with said connector.

6. Apparatus as defined in claim 1 wherein said first transition is right angular.

7. Apparatus as defined in claim 6 wherein said second transition is greater than a right angle.

8. Apparatus as defined in claim 5 wherein said neck is joined to said cross bar by an intermediate region having a smaller diameter than said neck.

9. Apparatus as defined in the preceding claim wherein said neck has a tapered transition to said intermediate region.

10. Apparatus as defined in the preceding claim wherein said taper is at an angle of 45 degrees with respect to the axis of said neck.

11. Apparatus as defined in claim 1 wherein said cross bar is joined to a further bar which extends transversely thereto.

12. Apparatus as defined in claim 9 wherein a plurality of fasteners are joined to said transverse bar.

13. Apparatus as defined in claim 10 where adjacent cross bars are separated from one another by about one-half the diameter of each cross bar.

* * * * *